US005567126A

United States Patent [19]

Meece et al.

[11] Patent Number: 5,567,126

[45] Date of Patent: Oct. 22, 1996

[54] SYSTEM AND METHOD FOR PREVENTING THE RELEASE OF VAPOR INTO THE ATMOSPHERE

[75] Inventors: Meredith W. Meece; William T. Thurmon, both of Monroe, La.

[73] Assignee: Thomas Industries Inc., Monroe, La.

[21] Appl. No.: 555,344

[22] Filed: Nov. 8, 1995

Related U.S. Application Data

[63] Continuation of Ser. No. 188,761, Jan. 31, 1994, abandoned.

[51] Int. Cl.[6] ..... F04B 49/00

[52] U.S. Cl. ..... 417/310; 417/53; 418/261; 141/1; 141/59

[58] Field of Search ..... 418/260, 261, 418/270; 417/310, 410.3, 53; 141/1, 4, 5, 7, 59

[56] References Cited

U.S. PATENT DOCUMENTS

| | | | |
|---|---|---|---|
| 888,838 | 5/1908 | Müller | 418/260 |
| 2,925,786 | 2/1960 | Hill . | |
| 3,097,610 | 7/1963 | Swanson | 417/310 |
| 3,468,260 | 9/1969 | Belden | 417/410.3 |
| 3,473,478 | 10/1969 | Little | 417/310 |
| 3,639,090 | 2/1972 | Hutchins | 418/111 |
| 3,680,980 | 8/1972 | Bart | 417/310 |
| 3,826,291 | 7/1974 | Steffens . | |
| 3,883,273 | 5/1975 | King | 417/410.3 |
| 3,899,009 | 8/1975 | Taylor . | |
| 4,223,706 | 9/1980 | McGahey . | |
| 4,253,808 | 3/1981 | White | 418/126 |
| 4,260,000 | 4/1981 | McGahey et al. . | |
| 4,306,594 | 12/1981 | Planck . | |
| 5,038,838 | 8/1991 | Bergamini et al. | 141/59 |
| 5,040,577 | 8/1991 | Pope . | |
| 5,129,432 | 7/1992 | Dugger | 141/1 |
| 5,156,199 | 10/1992 | Hartsell, Jr. et al. . | |

FOREIGN PATENT DOCUMENTS

| | | | |
|---|---|---|---|
| 3314651 | 11/1983 | Germany | 417/410.3 |
| 666088 | 6/1988 | Switzerland | 417/410.3 |
| 741767 | 12/1955 | United Kingdom | 417/410.3 |
| 8300668 | 3/1983 | WIPO | 417/410.3 |

*Primary Examiner*—Charles G. Freay
*Attorney, Agent, or Firm*—Quarles & Brady

[57] ABSTRACT

A vane pump is provided which can be used for the pumping of gasoline vapor, particularly in a sealed environment. The vane pump has an inlet, an outlet and a safety valve that recirculates vapor from the outlet to the inlet when a blockage occurs upstream or downstream of the pump. The invention further provides a system and method, incorporating the pump, for recovering gasoline vapor proximal to a nozzle dispensing liquid gasoline.

5 Claims, 3 Drawing Sheets

SYSTEM AND METHOD FOR PREVENTING THE RELEASE OF VAPOR INTO THE ATMOSPHERE

This is a continuation of application Ser. No. 08/188,761 filed Jan. 31, 1994, now abandoned.

BACKGROUND OF THE INVENTION

The present invention generally relates to pumping fluid. More specifically, the invention relates to withdrawing and transferring vapor in a sealed manner.

Gasoline vapor is toxic and harmful to the environment. Traditional nozzles on gasoline pumps release harmful quantities such vapor into the atmosphere when such a nozzle is dispensing gasoline a fuel tank, such as that of an automobile. Many gasoline retailers take no steps to prevent this harmful release of fumes.

Adequate reduction or prevention of gasoline vapor release can be achieved by drawing off vapor adjacent to the dispensing of the liquid gasoline. A vacuum line can be attached to the nozzle structure so that a vacuum inlet is positioned adjacent to the end of the nozzle which dispenses the liquid gasoline.

An automobile gasoline tank generally has a tube extending to an opening which is fitted with a cap. A gasoline nozzle is inserted into this tube for dispensing gasoline into the tank. The gasoline vapor released from the liquid gasoline collects primarily within this tube. Therefore, simultaneous withdrawal of vapor from this proximity effectively recaptures the vapor before it is released into the atmosphere.

The withdrawn vapor is transferred to a processing device or back into the original storage tank where it condenses back into liquid gasoline. This essentially recycles the gasoline that otherwise would have harmed the environment. Therefore, a system for withdrawing and transferring the vapor must be sealed so that the vapor is not released into the atmosphere.

As gasoline is dispensed, vapor in the automobile tank is displaced from the tank in the same volume as the liquid flowing in. Similarly, the storage tank from which the gasoline is being dispensed should receive vapor at the same rate, in order to remain at the same pressure. If a greater volume of vapor were transferred to the storage tank than the volume of liquid removed, pressure would build up in the storage tank and eventually release into the atmosphere.

Desirably, vapor is withdrawn proximal to the nozzle at the same volumetric rate that the liquid gas is being dispensed. That vapor is transferred back to the storage tank. Such a vapor withdrawal rate insures that toxic vapor is sufficiently withdrawn at the nozzle. Also, such a vapor withdrawal rate insures that the pressure in the storage tank remains constant.

In a vapor recovery system for a gasoline pump, the vapor pump desirably runs only intermittently-when gasoline is being dispensed. During periods of nonuse, it is desirable to prevent vapor from freely flowing toward the nozzle.

Pumping vapor by means of fans or vaned devices is known. For example, propellers are sometimes used for moving vapor, as on an airplane or a table fan. A propeller can be ducted for pumping vapor through a tube. However, a propeller pump can leak vapor between its blades, especially at low velocities. Furthermore, a ducted propeller allows free flow between its blades when stationary. This makes such a pump impractical for pumping precise quantities of vapor. It is also impractical for pumping in a leak-free application.

A vane pump generally provides a means for pumping vapor in a more precise manner than a propeller type pump. A vane pump has a plurality of flat vanes rotating in a chamber. Between adjacent vanes, a discrete pocket of vapor is moved from an inlet to an outlet within the chamber. The vanes are slidably mounted in a rotor which is offset within the chamber so that the volume of the pocket expands as it moves past the inlet, and contracts as it passes the outlet.

A vane pump thereby provides a system for drawing in and pumping out controlled volumes of vapor. However, a traditional vane pump is impractical for pumping gasoline vapor. Gasoline vapor leaves a residue on pump components which can cause vanes in a traditional pump to stick. Furthermore, a traditional vane pump can leak vapor around a shaft on which the rotor is mounted.

Blockage downstream from a pump causes high fluid pressure to build up between the pump and the blockage. Similarly, an upstream blockage can cause a vacuum buildup. Such pressure can damage components. It is necessary to prevent pressure or vacuum buildup when such a blockage occurs. A common safety system simply vents the pumped vapor from the system through a valve. However, when the vapor is toxic, such a release is undesirable.

Therefore, a need exists for a safety device on a vapor pump that is activatible upon an upstream or downstream blockage that does not vent fluid into the atmosphere.

Furthermore, a need exists for a vane pump that can reliably be used for pumping gasoline vapor.

A need also exists for withdrawing vapor proximal to a nozzle outlet and pumping that vapor in a sealed manner. A need also exists for a vapor recovery system capable of withdrawing and transferring vapor a precise volumetric rate.

Therefore, a further need exists for a vapor pump that does not allow vapor flow through the pump when it is not operating.

SUMMARY OF THE INVENTION

The present invention provides a vane pump that overcomes the deficiencies of prior art pumps. It is suitable for pumping gasoline vapor. Furthermore, it is particularly well suited for use in a system for withdrawing gasoline vapor without leakage into the environment.

To this end, in an embodiment, a pump is provided that has a cylindrical housing. A cylindrical rotor is rotatably positioned within the housing in an offset manner such that a generally crescent-shaped chamber is defined between the rotor and the housing. An inlet is positioned at a first narrow portion of the crescent-shaped chamber. An outlet is positioned at a second narrow portion of the crescent-shaped chamber. A plurality of vanes are provided. Each vane is slidably mounted in an associated slot in the rotor, such that a plurality of pockets are defined in the crescent-shaped chamber between adjacent vanes. Each pocket increases in volume as it passes the inlet, and decreasing in size as it passes the outlet. A safety valve opens fluid communication between the inlet and the outlet at a predetermined pressure differential between the inlet and the outlet.

In an embodiment, each vane has an outer edge and an inner edge. The housing has an axis. A circular member having a diameter smaller than the rotor is positioned to have an axis in common with the housing. The inner edge of each vane can contact the circular member and the outer edge of each vane can contact the housing to slidably position the outer edge of each vane in contact with or proximal to the housing as the rotor rotates.

In an embodiment, the rotor has an axis. The slots in the rotor each occupy a plane which intersects the axis of the rotor.

In an embodiment, the safety valve comprises a passage between the inlet and the outlet, a spring, a stopper, and a seal. The spring biases the stopper against the seal against a direction of flow from the outlet to the inlet through the passage.

In an embodiment, each slot has a width and each vane has a thickness such that the difference between the width and the thickness is 0.8% to 5.5% of the vane thickness.

In an embodiment, a motor shaft extending through the housing to drive the rotor and a shaft seal for sealing between the motor shaft and the pump housing.

In a related embodiment, the shaft seal has a lip is made of an elastomer.

In an embodiment, a motor shaft extends through the housing for driving the rotor. The rotor has a bore. The rotor is not rigidly connected to the shaft. The shaft extends into the bore where it is rotatably locked by a key.

In a related embodiment, the clearance between the motor shaft and the bore is 0.0005 to 0.0015 inches.

The present invention also provides a method for preventing the release of vapor into the atmosphere. The invention is particularly appropriate for preventing the release of toxic gasoline fumes into the atmosphere when an automobile is being fueled.

To this end, in an embodiment, a method is provided for preventing the release of vapor from liquid dispensed from a nozzle. A pump is activated. The pump has an inlet that is in fluid communication with an orifice proximal to the nozzle. The pump also has outlet that is in fluid communication with a tank. The pump creates a vacuum at the inlet. A flow of the vapor is withdrawn through the orifice. The flow of the vapor is transferred through the pump. The vapor is deposited into the tank. The flow can be recirculated through the pump by opening fluid communication between the outlet and the inlet when a predetermined pressure differential between the inlet and the outlet is exceeded.

In an embodiment, the tank is also used for storing the liquid before it is dispensed.

It is, therefore, an advantage of the present invention to provide a vane pump that can be used for pumping gasoline vapor.

A further advantage of the present invention is to provide a pump that recirculates vapor through the pump instead of venting vapor into the atmosphere when there is a blockage upstream or downstream of the pump.

Another advantage of the present invention is to provide a pump that does not leak vapor into the atmosphere.

Yet another advantage of the present invention is to provide a system and method for withdrawing vapor from proximal to a gasoline pump nozzle to prevent the harmful effect of gasoline vapor into the atmosphere.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
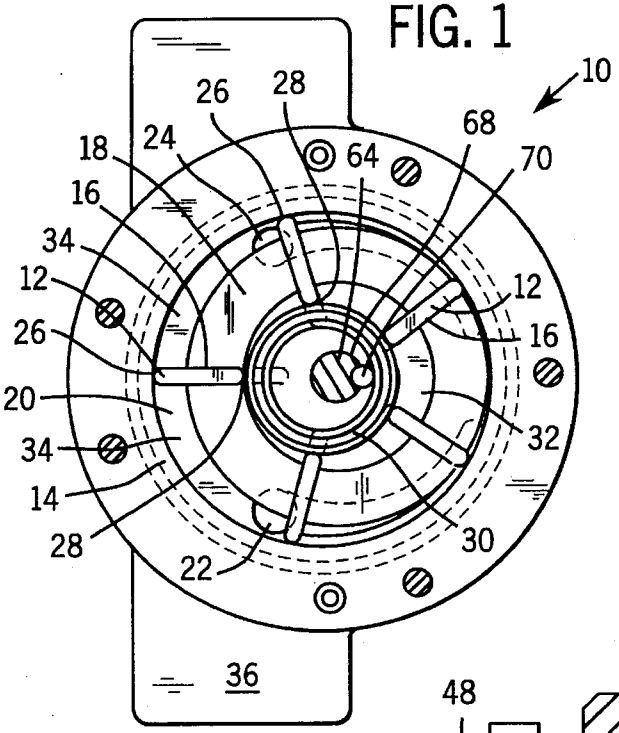
FIG. 1 illustrates a sectional bottom view of the pump.

Referring to the figures, FIG. 1 shows a vane pump 10 embodying the features of present invention. The vane pump 10 has a plurality of flat vanes 12 which can revolve within a cylindrical housing 14. The vanes 12 are slidably mounted in slots 16 in a cylindrical rotor 18, which rotates within the cylindrical housing 14.

The rotor 18 and the cylindrical housing 14 each have an axis. The axis of the rotor 18 is offset from the axis of the housing 14, although the two axes are parallel. The rotor 18 has a smaller diameter than the diameter of the cylindrical housing 14. The rotor 18 is rotatably positioned within the cylindrical housing 14 so that the rotor 18 is close to the housing 14. A generally crescent-shaped chamber 20 is thereby formed between the rotor 18 and the housing 14.

The crescent-shaped chamber 20 has an inlet 22 and an outlet 24. The inlet 22 and the outlet 24 are positioned at opposite ends of the crescent-shaped chamber 20, where the chamber 20 tapers.

Each vane 12 has an outer edge 26 and an inner edge 28. The vanes 12 are carried by the rotor 18 to sweep through the chamber 14 so that the outer edges 26 are close to, or in contact with the cylindrical housing 14. Because the distance between the rotor 18 and the housing 14 varies at points around the housing 14, the vanes 12 are slidable within the slots 16 to maintain such a position relative to the housing 14 as they revolve.

A circular control ring 30 is provided for causing the proper sliding action of the vanes 12. The control ring 30 is positioned within a recess 32 of the rotor, and is positioned on the axis of the cylindrical housing 14. The control ring 30 is sized to contact the inner edges 28 of the vanes 12 as the vanes 12 rotate.

In the embodiment shown by FIG. 1, the rotor 18 rotates clockwise. Contacting the control ring 30, the vanes 12 slide outward where the crescent-shaped chamber 20 widens. Contacting the housing 14, the vanes 12 slide inward where the chamber 20 shape narrows. Preferably, the rotor slots 16 are oriented so that the plane of each vane 12 is parallel to the axis of the rotor.

Between adjacent vanes 12, a pocket 34 is formed. The volume of each pocket 34 changes in size as the vanes travel through the crescent-shaped chamber 20. The volume of a pocket 34 increases as it travels past the inlet 22, drawing vapor into the pocket 34. The volume each pocket 34 decreases as it travels past the outlet 24, forcing vapor out of the pocket 34. This draws in a specific volume of vapor from the inlet 22 and expels the same quantity from the outlet 24. Thus, the pump 10 transfers finite pockets of vapor. The pump 10 can thereby controllably transfer precise quantities of vapor. Furthermore, because the vanes 12 are positioned against the housing 14, there is preferably little or no flow through the pump 10 when it is not running.

The pump 10 can be used for pumping many fluids, including gasoline vapor. Preferably, the rotor 18 and vanes 12 are made of carbon or a carbon composite material. Furthermore, the clearance between each vane 12 and its associated slot 16 is preferably 0.8%–5.5% of the vane thickness. With such a tolerance, gasoline vapor residue buildup does not significantly impede the sliding action of the vanes.

Figure 2:
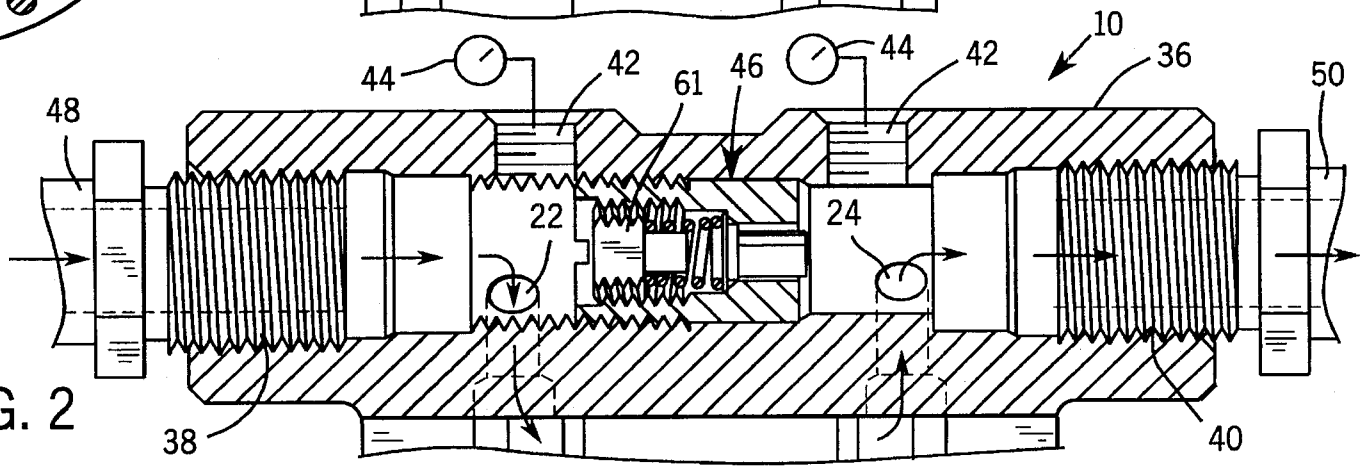
FIG. 2 illustrates a fragmentary sectional side view of the pump.
Figure 3:
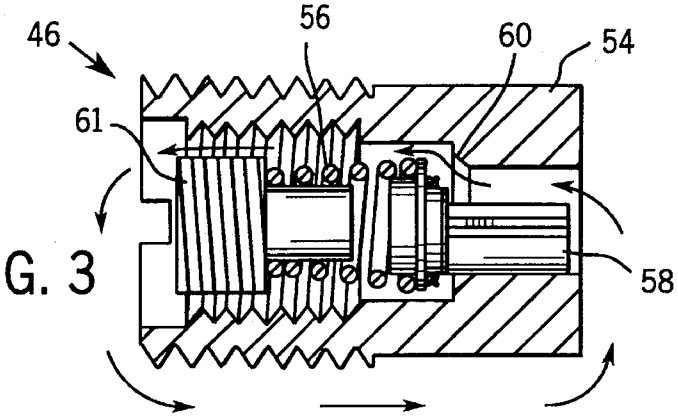
FIG. 3 illustrates a sectional view of the safety valve.

Turning to FIG. 2, a pump head 36 is provided on the pump 10. The head 36 has an inlet passage 38 which is fluid communication with the inlet 22. The head 36 also has an outlet passage 40 which is in fluid communication with the outlet 24. Ports 42 are provided in both the inlet passage 38 and the outlet passage 40 which can be used to connect a device for measuring pressure 44. As illustrated in FIGS. 2, and 3, a safety valve 46 is provided on the pump 10. As shown in FIG. 2, a first tube 48 is in fluid communication with the inlet passage 38. The pump 10 creates a vacuum in the inlet passage and the first tube 48. A second tube 50 is in fluid communication with the outlet passage 40. The pump 10 increases the pressure in the second tube 50. A flow is created by the pump 10 from the first tube 48, through the pump 10, and out through the second tube 50, as indicated by the arrows in FIG. 2.

A blockage upstream in the first tube 48 would cause a vacuum buildup in the pump 10. Similarly, a downstream blockage in the second tube 50 would cause a pressure buildup.

To prevent potential damage in the event of such a buildup, the safety valve 46 opens fluid communication between the outlet passage 40 and the inlet passage 38 when a predetermined pressure differential between them is exceeded. This opens fluid communication between the inlet 22 and the outlet 24, allowing vapor to recirculate through the pump 10.

The safety valve 46 does not vent vapor into the atmosphere. If the vapor is gasoline vapor, such a release would be harmful to the environment. Therefore, in order to minimize harmful effects, the vapor is continually recirculated until the blockage is cleared. When the blockage is cleared, the pressure differential between the inlet 22 and outlet 24 reaches a normal level, at which the safety valve 46 closes.

Figure 4:
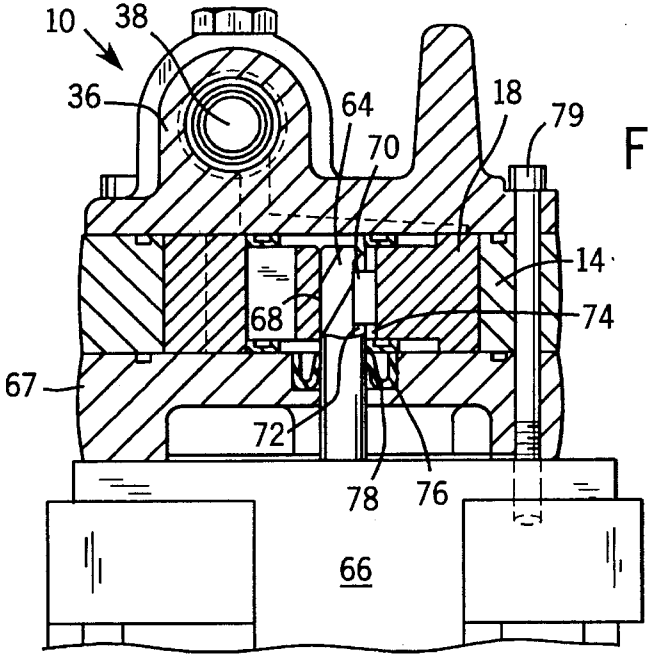
FIG. 4 illustrates a sectional side view of the pump.

FIG. 3 illustrates a preferred embodiment of the safety valve 46. A tubular valve body 54 is provided. The tubular valve body 54 defines a passage between the outlet passage 40 and the inlet passage 38. Within the body 54, a spring 56 normally biases a stopper 58 against a surface 60 against the direction of flow from the outlet 24 to the inlet 22, the direction of flow being indicated by the arrows. The spring 56 abuts a bridge 61 which is threaded into the tubular valve body 54. When the pressure differential between the outlet 24 and the inlet 22 is less than the predetermined level, the stopper 58 fits against the surface 60, preventing flow through the valve 46, thus preventing flow from the outlet 24 to the inlet 22. When the pressure differential between the outlet 24 and the inlet 22 exceeds the predetermined level, the stopper 58 is forced away from the surface 60, allowing flow through the tubular valve body 54 from the outlet 24 to the inlet 22, protecting the components from over-pressurization or over-suction. For instance, over-pressurization or over-suction could seize the pump 10, causing possible damage. FIG. 4 illustrates the safety valve 46 in the open position.

The connections of first tube 48 and second tube 50 are connected to the head 36 atop the pump 10. Plugs are disposed in the ports 42 which are preferably closed unless connected to a pressure measuring device.

As illustrated by FIG. 4, the rotor 18 is driven by a motor shaft 64 which is connected to a motor 66, such as an electric motor. Preferably, the motor 66 is a brushless D.C. motor for safer operation near flammable gasoline vapor. Furthermore, the motor 66 can be operated at variable speeds for pumping vapor at variable flow rates. An adapter plate 67 is located between the housing 14 and the motor 66 for attaching the pump 10 to a particular motor 66. The adapter plate 67 forms one side of a cylindrical space with the housing 14, and the rotor 18 is received in the cylindrical space.

The motor shaft 64 fits into a bore 68 in the rotor 18. Preferably, the rotor 18 is not rigidly connected to the shaft. There is preferably a clearance of 0.0005 to 0.0015 inches in the rotor bore 68 between the rotor 18 and the shaft 64. The rotor 18 is rotatably locked to the motor shaft 64 by a key 70 which fits between a notch 72 in the motor shaft 64 and a groove 74 in the bore 68. This is also illustrated in FIG. 1.

Also illustrated in FIG. 4 is an annular shaft seal 76 disposed in the adapter plate 67 around the shaft 64. The shaft seal 76 is to prevent vapor leakage out from the cylindrical housing 14 or adapter plate 67 into the atmosphere during pump operation. The shaft seal 76 preferably has a U-shaped cross-section. Also, the shaft seal 76 preferably has a seal lip 78 which is made of an elastomer such as VITON®. VITON® is not typically used in such a dry-running application. However, it is believed that for a compatible surface speed and finish of the motor shaft 64, the shaft seal 76 will endure 10,000 hours of pump operation without leakage.

FIG. 4 further illustrates the integral, stacked relationship among the pump head 36, housing 14, adapter plate 67, and motor 66. These components are preferably retained together by bolts 79.

Figure 2A:
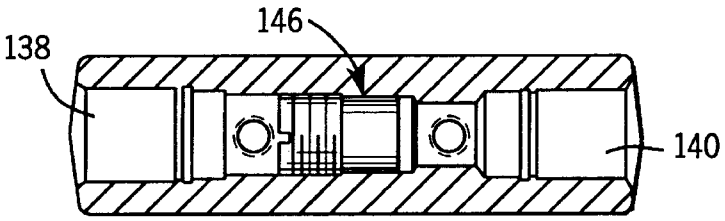
FIG. 2A illustrates a sectional view of an alternative embodiment of a pump head taken generally along line IIA—IIA in FIG. 6.
Figure 6:
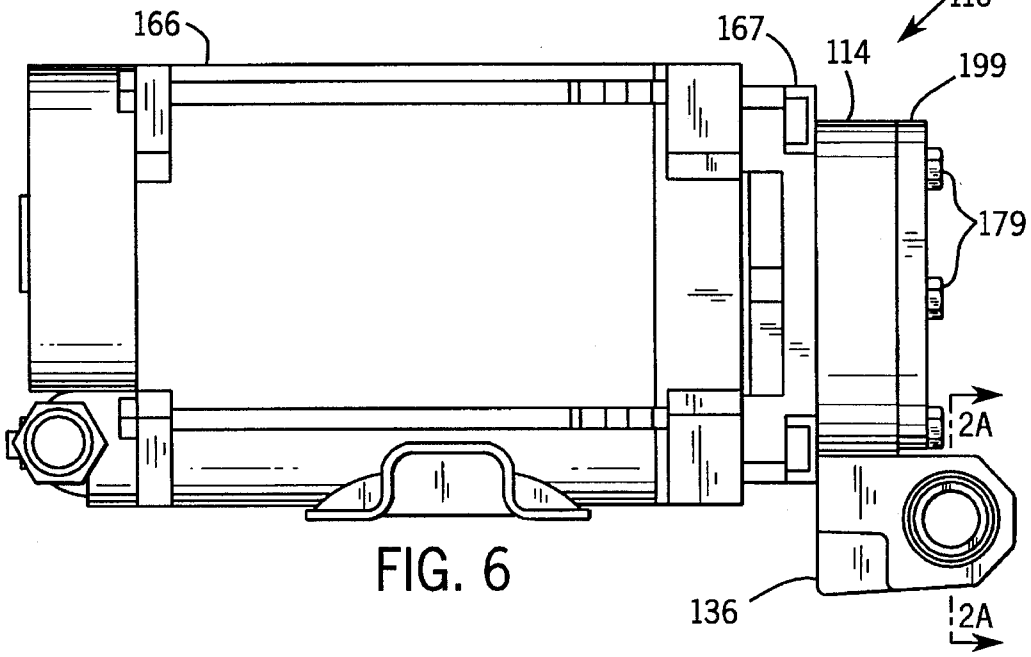
FIG. 6 illustrates a side view of an alternative pump embodiment.
Figure 5:
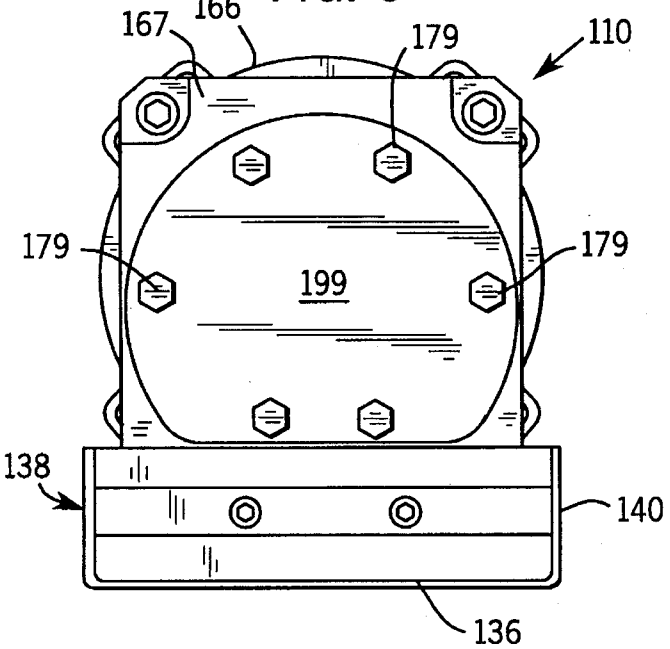
FIG. 5 illustrates a top view of an alternative pump embodiment.

An alternative embodiment of a pump 110 is shown in FIGS. 2A, 5 and 6. In this alternative embodiment, a pump head 136 is arranged to have an inlet passage 138 and an outlet passage 140 positioned radially adjacent to the housing 114. The passages 138 and 140 each can communicate through the housing 114. An end cap 199 is secured to the housing 114. Disposed between the inlet passage 138 and outlet passage 140 is a safety valve 146. This alternative configuration works substantially the same as the embodiment described above. The alternative embodiment also has a stacked configuration, having the housing 114, an adapter plate 167 and a motor 166 retained together by bolts 179.

Figure 7:
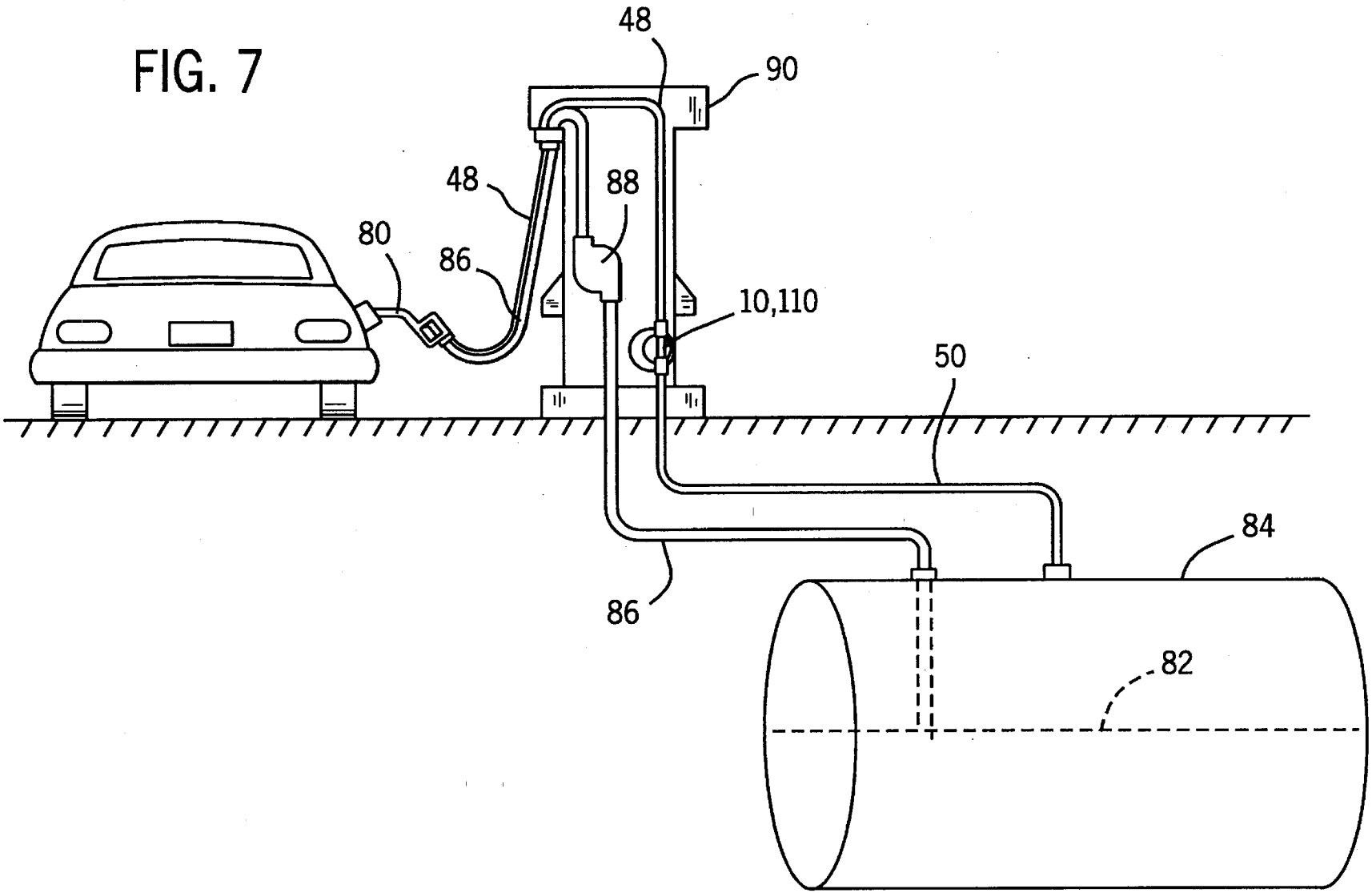
FIG. 7 illustrates a flow circuit embodying features of the present invention.

A preferred embodiment is illustrated by FIG. 7 which shows a system for recovering vapor from a gasoline pump nozzle 80. The present invention provides a method of using this system which incorporates the above-described pump 10 and 110.

Liquid gasoline 82 is stored in a tank 84, which can be underground. Liquid gasoline is transferred through a gasoline line 86 from the tank 84 to the nozzle 80 via a liquid gasoline pump 88. The pump 10, 110 and liquid gasoline pump 88 can be housed in an enclosure 90.

Liquid gasoline tends to evaporate. Therefore, through an orifice that is proximal to the dispensing of gasoline from the nozzle 80, vapor is drawn into the first tube 48. As described above, the first tube 48 is in fluid communication with the inlet 22 of the pump 10, which creates a vacuum. The withdrawal of vapor adjacently to the nozzle 80 effectively recaptures the gasoline vapor before it is released into the atmosphere.

The withdrawn vapor is transferred through the vapor pump 10 and through the second tube 50. The second tube 50 is in communication with the tank 84. The vapor returned to the tank 84 can condense back into liquid gasoline 82. This essentially recycles gasoline that otherwise would have harmed the environment.

Preferably, the pump 110 is controlled to variably transfer vapor at the same volumetric rate that the liquid gasoline 82 is being dispensed. Such a vapor withdrawal rate insures that toxic vapor is sufficiently withdrawn at the nozzle 80. Moreover, such a vapor withdrawal rate insures that the pressure in the tank 84 does not become over-pressurized or under-pressurized.

Should there become a blockage in either the first tube 48 or the second tube 50, the safety valve 46 or 146 recirculates vapor through the pump 10 or 110, respectively. This prevents the system from damage from over-pressurization or over-suction.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. In a pump having a cylindrical housing, a cylindrical rotor rotatably positioned within the housing in an offset manner such that a generally crescent-shaped chamber is defined between the rotor and the housing, a fluid inlet at a first narrow portion of the crescent-shaped chamber, a fluid outlet at a second narrow portion of the crescent-shaped chamber, and a plurality of vanes, each of which is slidably mounted in an associated slot in the rotor, such that a plurality of pockets are defined in the crescent-shaped chamber between adjacent vanes, each pocket increasing in volume as it passes the inlet, and decreasing in size as it passes the outlet, the improvement wherein:

each slot has a width and each vane has a thickness such that the difference between the width and the thickness is 0.8% to 5.5% of the vane thickness.

2. A method of preventing the release of vapor from liquid dispensed from a nozzle comprising the steps of:

activating a pump when liquid is dispensed from the nozzle, the pump having an inlet that is in fluid communication with an orifice proximal to the nozzle and an outlet that is in fluid communication with a tank, the pump creating a vacuumat the inlet;

withdrawing a flow of the vapor through the orifice;

transferring the flow of the vapor through the pump;

depositing the vapor into the tank; and recirculating the entire vapor flow through the pump by opening fluid communication between the outlet and the inlet when a predetermined pressure differential between the inlet and the outlet is exceeded thereby indicating a blockage upstream or downstream of the pump.

3. The method of claim 2 wherein the tank is also used for storing the liquid before it is dispensed.

4. The method according to claim 2 wherein the pump is comprised of:

a cylindrical housing;

a cylindrical rotor rotatably positioned within the housing in an offset manner such that a generally crescent-shaped chamber is defined between the rotor and the housing wherein the inlet is positioned at a first narrow portion of the crescent-shaped chamber and the outlet is positioned at a second narrow portion of the crescent-shaped chamber; and a plurality of vanes, each of which is slidably mounted in an associated slot in the rotor, such that a plurality of pockets are defined in the crescent-shaped chamber between adjacent vanes, each pocket increasing in volume as it passes the inlet, and decreasing in size as it passes the outlet, and wherein the recirculating step is performed by a safety valve dispersed intermediate the outlet and the inlet, the safety valve comprising a spring, a stopper, and a surface such that the spring normally biases the stopper to fit against the surface against a direction of flow from the outlet to the inlet.

5. A method according to claim 4 wherein the pump is further comprised of:

an axis of the housing; and a ring having a diameter smaller than the rotor, the ring being positioned to have an axis in common with the housing;

wherein the inner edge of each vane can contact the ring and the outer edge of each vane can contact the housing to slidably position the outer edge of each vane in contact with or proximal to the housing as the rotor rotates.

* * * * *